US008118066B2

(12) United States Patent
Mühlhausen et al.

(10) Patent No.: US 8,118,066 B2
(45) Date of Patent: Feb. 21, 2012

(54) SYSTEM FOR REPLENISHING FLOWABLE OR POURABLE WASHING OR CLEANING AGENTS

(75) Inventors: Hans-Georg Mühlhausen, Düsseldorf (DE); Kamel Rahal, Düsseldorf (DE); Wolfgang Barthel, Langenfeld (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/876,522

(22) Filed: Sep. 7, 2010

(65) Prior Publication Data

US 2011/0011494 A1 Jan. 20, 2011

Related U.S. Application Data

(63) Continuation of application No. PCT/EP2008/063338, filed on Oct. 6, 2009.

(30) Foreign Application Priority Data

Mar. 6, 2008 (DE) ..... 10 2008 012 973

(51) Int. Cl.
*B65B 1/04* (2006.01)

(52) U.S. Cl. ..... 141/18; 141/319; 141/330; 141/363; 141/366

(58) Field of Classification Search ..... 141/2, 18, 141/114, 312, 319, 329, 330, 363, 366; 222/81
See application file for complete search history.

(56) References Cited

U.S. PATENT DOCUMENTS 3,004,566 A * 10/1961 Raimo ..... 141/18
4,614,437 A 9/1986 Buehler
5,687,865 A * 11/1997 Adams et al. ..... 215/253
5,746,260 A 5/1998 Vesborg

FOREIGN PATENT DOCUMENTS

EP 0421539 A1 4/1991

* cited by examiner

*Primary Examiner* — Gregory Huson
*Assistant Examiner* — Jason Niesz
(74) *Attorney, Agent, or Firm* — David P. LeCroy

(57) ABSTRACT

System for replenishing washing or cleaning agents, comprising a spout placeable on the opening of a bottle and having a first collar with a fastener for fastening the spout to a bottle, a second collar with a fastener for fastening a closure and/or metering cap on the spout, a wall extending from the first collar or second collar, a funnel, and an adapter element connectable to the pouring opening of a replenishing container and that comprises a cylinder element and a peripheral collar, a membrane for closing the replenishing container and preventing leakage of washing or cleaning agents out of the replenishing container, wherein the cylinder element of the adapter element has a guide groove configured such that the cylinder element can be detachably placed over the funnel and the web of the spout, whereby the positioning of the adapter element relative to the spout is determined.

6 Claims, 6 Drawing Sheets

SYSTEM FOR REPLENISHING FLOWABLE OR POURABLE WASHING OR CLEANING AGENTS

CROSS REFERENCE TO RELATED APPLICATIONS

The present application is a continuation of PCT/EP2008/063338 filed 6 Oct. 2008, which claims the benefit of German Patent Application No. 10 2008 012 973.9 filed 6 Mar. 2008, both of which are incorporated herein by reference.

The invention relates to a system for refilling flowable or pourable washing or cleaning agents from a refill container into a bottle provided with a pourer.

A large number of systems are known from the prior art for refilling products from a transport vessel into a storage vessel.

Such systems have the advantage that the transport packaging is conventionally made with small amounts of material and little processing effort, such that it brings with it significant savings in raw materials and consequent cost and environmental advantages over storage vessels.

Crucial to the acceptance of such systems by the consumer, however, is not just the matter of cost but also the issue of simple and convenient handling when refilling the storage vessel by means of the transport packaging.

These days, storage vessels often have pourers positioned on their mouth which allow convenient, precise pouring out and metering of the container contents. Such pourers are increasingly widely used particularly for bottles containing liquid washing agents.

An example of a refill system is illustrated in U.S. Pat. No. 4,614,437. The system consists of a pourer positionable on a bottle to which a refill container may be coupled in such a manner that, on positioning of the refill container onto the pourer, the pourer pierces the sealing film/foil closing the orifice of the refill container, allowing the contents of the refill container to flow into the bottle.

A significant disadvantage of this solution is that the sealing film/foil for closing the refill container has to be so thin that it can still be pierced without excessive force when positioning the refill container onto the pourer. This leads to the risk of such a film/foil being damaged unintentionally during transportation and the contents of the refill container unintentionally pouring out. This may occur in particular if a consumer places such a refill container in a shopping trolley or shopping bag with other products, wherein the corners of a piece of product packaging or slender products such as pencils may destroy the sealing film/foil of the refill container due to unavoidable relative movements between the goods transported in this way.

An additional closing cap for protecting the film/foil from mechanical intervention is conceivable in principle, but such an additional component appreciably increases the cost of a refill container, whose purpose is to be as inexpensive as possible. Moreover, in addition to production of the component an additional closing cap also adds an additional fitting step to the finishing of a corresponding refill container, as a result of the need to screw or snap it on.

It is additionally undesirable for refill containers to be arbitrarily couplable to a particular storage vessel, for example, if products which are not storage-stable together are unintentionally mixed together as a result of a refill process.

The object of the invention is therefore to provide a system for refilling flowable or pourable washing or cleaning agents from a refill container closed by a membrane into a bottle provided with a pourer, in which the film/foil of the refill container is protected inexpensively from mechanical intervention, can be pierced in a convenient manner by the pourer without excessive force and which prevents unintentional refilling of products which should not be mixed together.

This object is achieved by a refill system having a pourer (1) positionable on the orifice of a bottle (15). The pourer includes a first collar (8) with a fastener (5) for liquid-tight fastening of the pourer (1) on a bottle (15), a second collar (7) with a fastener (6) for liquid- and/or gas-tight fastening of a closure and/or dispensing cap (16) on the pourer (1), a wall (10) extending from the first collar (8) or second collar (7) towards the interior of the bottle, a funnel (9) extending from the shoulder (17) of the wall (10) beyond the collar (6) out of the side of the pourer (1) turned away from the interior of the bottle, the funnel (9) comprising a funnel orifice (11), and an adapter element (3) couplable with the pouring orifice of a refill container (2). The adapter element (3) includes a cylinder element (21) and a peripheral collar (22) connected to the cylinder element (21), on which a fastening element (24) is arranged on the peripheral collar for liquid-tight fastening of the adapter element (3), a membrane (26) which, in the mounted state of the adapter element (3) on the refill container (2), closes the refill container (2) and prevents leakage of flowable or pourable washing or cleaning agents out of the refill container (2), in particular also in the inverted position of the refill container (2). The cylinder element (21) of the adapter element (3) comprises a guide groove (20) which is configured such that the cylinder element (21) may be detachably pushed over the funnel (9) and the web (19) of the pourer (1) protruding from the funnel plane, so fixing the position of the adapter element (3) relative to the pourer (1).

The system according to the invention for refilling flowable or pourable washing or cleaning agents achieves the result explained above with a structurally very simple solution which is also easy to handle, in particular by making use of the lock and key principle and providing accurate guidance and relative positioning when coupling adapter element and pourer, which is explained in greater detail below.

LIST OF REFERENCE SIGNS

Figure 1:
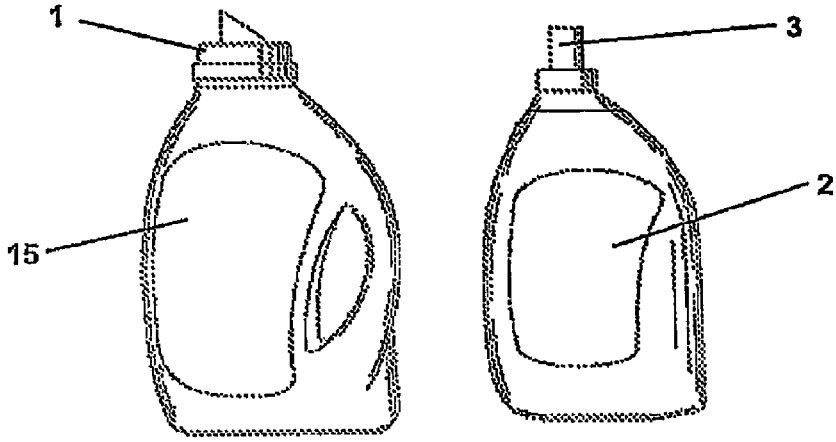
FIG. 1 is a front plan view of a bottle with pourer and a refill container with container orifice in the uncoupled state.

1. Pourer
2. Refill container
3. Adapter element
5. Thread
6. Thread
7. Collar
8. Collar
9. Funnel
10. Wall
11. Funnel orifice
12. Rim
13. Wall
14. Base
15. Bottle
16. Closing cap
17. Shoulder
18. Neck
19. Web
20. Guide groove
21. Cylinder
22. Collar
23. Tip
24. Thread
25. Orifice
26. Membrane
27. Thin area
28. Guide ribs
29. Guide ribs
30. Orifice Adapter Element—

The system according to the invention for refilling a pourable or flowable washing or cleaning agent comprises, in addition to the bottle provided with a pourer described in greater detail below, a refill container on whose pouring orifice an adapter element is arranged.

The task of the adapter element is to couple the refill container to the pourer in such a way that the contents of the refill container pass reliably from the refill container, through the pourer into the bottle.

Because the adapter element is provided with a fastening means for liquid-tight fastening to a refill container, the adapter element may be connected to refill containers of any desired shape. The fastening between the refill container and the adapter element may be bonded, interlocking or frictional and detachable or non-detachable.

It is particularly preferable for the fastening element to take the form of a screw fastening, rebound connection, snap-fit/latching connection, adhesive joint or a combination thereof.

The adapter is preferably made from a plastics material, in particular using an injection molding process.

The adapter additionally comprises a cylinder element and a peripheral collar connected to the cylinder element.

The projection of the cylinder element preferably results in a circular or oval outline. However other shapes are also feasible for the cylinder element, providing they correspond with the shape of the funnel in such a manner that the adapter may be coupled to the pourer for the purpose of refilling. The cylinder element is therefore not limited to a circular or oval projection outline.

The cylinder element further comprises a guide groove configured so that the cylinder element may be detachably pushed over the funnel and a web of the pourer protruding from the funnel plane, so fixing the position of the adapter element relative to the pourer.

In this way, the adapter element is pushed over the funnel of the pourer in accordance with a lock and key principle. A configuration according to such a lock and key principle displays a series of advantages. On the one hand it is ensured that only refill containers intended for refilling and provided with a corresponding adapter may be coupled to the pourer. This prevents the occurrence of undesired mixing of for example washing agent compositions not suitable for storage together, if for example a residual quantity of a first washing agent composition is present in the bottle but said bottle is to be filled with a second washing agent composition before it has been fully emptied.

In addition, as has already been described above, upon coupling of the adapter to the pourer, the position of the adapter element relative to the pourer is fixed by the guide groove and the web. Turning of the adapter in the coupled state is thus prevented, for example. In this way it is ensured that on coupling the funnel of the pourer always pierces the membrane of the adapter element in one or a plurality of defined areas, such that this piercing area or these piercing areas of the membrane may be specially configured. For a simple coupling process which does not require too much force on the part of the user, one or more thin areas may therefore be provided in the membrane in a thus defined and fixed piercing area. Structural weakening of the membrane may thereby be limited spatially and kept to a minimum, whereby the membrane thickness and the quantity of material needed therefor may be reduced to the necessary minimum.

Moreover, the web of the pourer and the corresponding groove on the adapter element prevents a refill container without a corresponding groove from being positioned onto the pourer, such that inadvertent refilling with a product not suitable for refilling is very largely prevented.

In addition to its generic function as a pouring aid, the pourer at the same times functions as an opening aid for the membrane of the adapter, making it possible to dispense with an additional opening aid.

In a further advantageous configuration of the invention, at least one ramp-shaped guide rib is arranged on the inside of the cylinder element, the guide rib extending from the pouring orifice of the cylinder element to the membrane. In this way, during the coupling process the funnel of the pourer, a degree of play conventionally being present between the funnel and the cylinder element of the adapter, is guided in a controlled manner against the area of the membrane designed to be pierced. It is thus ensured that, despite the play between funnel and cylinder element, which is necessary even for simple pushing of the adapter over the funnel, the funnel is positioned accurately relative to the thin area designed to be pierced.

Furthermore, the adapter element is advantageously configured in such a way that the guide groove ends at a distance from the pouring edge of the cylinder element and a substantially V-shaped orifice extends from the guide groove to the pouring edge of the cylinder element. In this way pushing of the adapter element over the funnel is simplified, since the web is guided automatically by the V-shaped orifice into the guide groove during the coupling process. It is thus not necessary to position the guide groove absolutely accurately over the web, since the V-shaped orifice allows compensation of a degree of inaccuracy in the positioning of guide groove relative to web during the coupling process.

Refill Container—

The refill container may take the form either of a dimensionally stable container, such as a bottle, can, carton or the like, or also of a flexible container, such as a pouch or tube.

It is particularly advantageous for the refill container to have a smaller average wall thickness than the bottle into which the contents of the refill container are to be poured.

Preferably, the refill container is made from a plastics material.

Membrane—

For the purposes of the present application, a membrane is understood to mean a flat closing element, which, in the mounted state of the adapter element on the refill container, closes the refill container and prevents leakage of flowable or pourable washing or cleaning agents out of the refill container, in particular also in the inverted position of the refill container, and may be pierced by the funnel of the pourer when the adapter element is coupled to the pourer by a user.

The membrane may be integral with the adapter element or be arranged, preferably bonded, as a separate part on the adapter element.

The membrane is advantageously made from a plastics material, such as PE, PP, PET or a metal such as aluminum.

The thickness of the membrane is from about 0.3 μm to about 1.5 μm, preferably from about 0.5 μm to about 1 μm.

Thin Areas—

For the purposes of the present applications, thin areas are weakenings in the material of the membrane which are formed, for example, by a reduction in material thickness.

In an advantageous configuration of the invention, the membrane comprises one or more thin areas which at least in part correspond to the projection of the funnel shape of the pourer.

It is particularly advantageous for the projection of the funnel shape to be a round or oval outline and at least one thin area is of linear construction and follows said outline at least in portions such that, when the adapter element is coupled with the pourer, the funnel abuts against the thin area.

In a further particularly preferred development of the invention the thin area comprises a substantially T-shaped portion which is configured such that, on coupling of the adapter element with the pourer, it abuts against the tip of the funnel.

Pourer—

The pourer is a device positionable in a liquid-tight manner on the pouring orifice of a bottle for controlled and convenient release of flowable or pourable washing or cleaning agents from the bottle, particularly by tilting the bottle from a standing into a delivery position. Such pourers are also known as "spouts".

The pourer is fixed in a liquid-tight manner to the pouring orifice of the bottle by a suitable fastening means. In particular, the fastening means may form a detachable or non-detachable, bonded or interlocking or frictional connection between the bottle orifice and the pourer. It is particularly preferable for the fastening element to take the form of a screw fastening, rebound connection, snap-fit/latching connection, adhesive joint or a combination thereof.

The pourer is preferably made from a plastics material, for example, by an injection molding process.

The pourer may moreover comprise a collar with a fastener for liquid- and/or gas-tight fastening of a closure cap and/or dispensing cap on the pourer, whereby the bottle may be closed in liquid-tight manner for the purpose of transport.

In addition, the pourer comprises a wall, which extends towards the interior of the bottle from which a funnel extends beyond the collar out of the side of the pourer turned away from the interior of the bottle, the funnel comprising a funnel orifice.

In a further development of the invention which is to be preferred, a tip is arranged on the part of the funnel orifice furthest away from the interior of the bottle, which tip projects beyond the edge of the funnel orifice. This tip significantly eases piercing of the membrane.

Moreover, it is advantageous for the funnel orifice to be constructed as an obliquely truncated tube, such that the user has a sufficiently good view of the product flowing out during pouring and can recognize when product is present at the delivery orifice of the funnel.

Bottle—

The bottle at whose pouring orifice the pourer is arranged takes the form of a dimensionally stable container, in particular of a bottle, can, carton or the like.

Preferably, the bottle is made from a plastics material and preferably comprises a handle.

Figure 2:
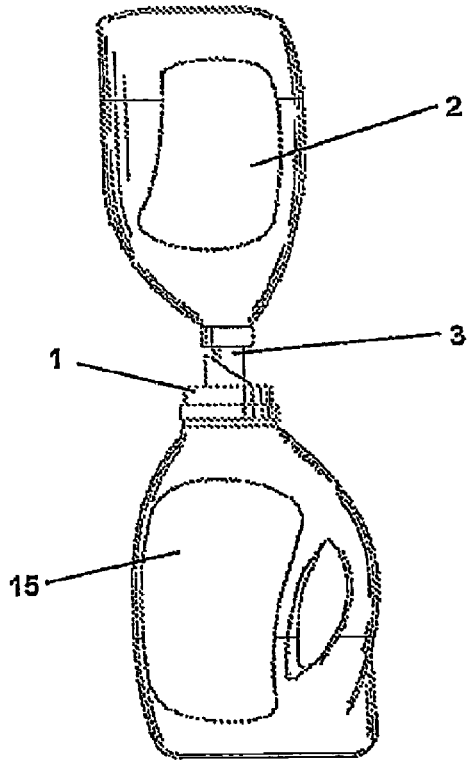
FIG. 2 is a front plan view of a bottle with pourer and a refill container with container orifice in the coupled state.

FIG. 1 shows a bottle 15 with pourer 1 as a storage vessel and a refill container 2 with the adapter element 3 in the uncoupled state of refill container 2 and bottle 15. The adapter element 3 is here configured such that it may be coupled to the pourer 1 of the bottle 15 when the refill container 2 is in the inverted position, as indicated in FIG. 2, such that the contents stored in the refill container 2 can flow under the effect of gravity out of the refill container 2 through the pourer 1 into the bottle 15.

Figure 3:
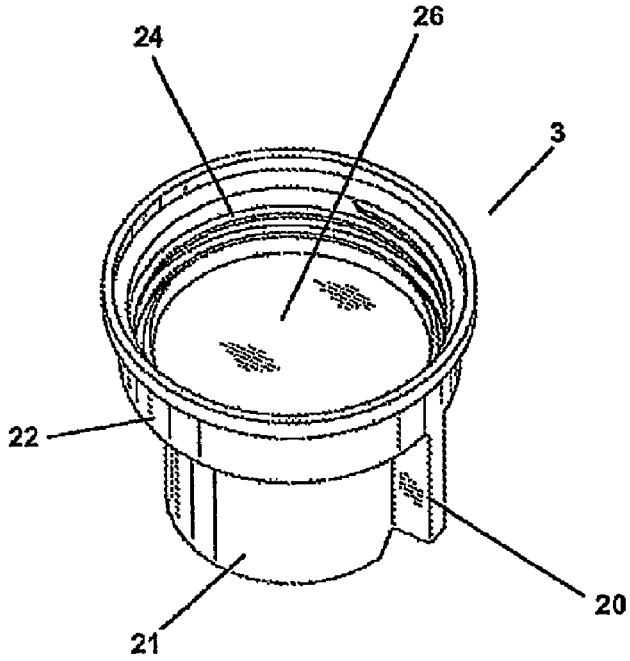
FIG. 3 is a perspective view of an adapter element illustrating the membrane surface on the refill container side.

The adapter element 3 is explained in greater detail below with reference to FIG. 3 and FIG. 4. FIG. 3 will be looked at first of all, which shows the adapter element 3 in a perspective view onto the membrane surface 26 on the refill container side.

The adapter element 3, which is preferably made from a plastics material, in particular using an injection moulding process, comprises a peripheral, cylindrical collar 22, on the inside of which an internal thread 24 is provided as fastening means for liquid-tight fastening on a refill container 2.

The adapter 3 additionally comprises a cylinder element 21 extending from the peripheral collar 22 in the direction away from the interior of the refill container. The cylinder element 21 and the collar 22 are arranged concentrically with one another, the collar 22 having a larger diameter than the cylinder 21.

Arranged between collar 22 and cylinder element 21 is the membrane 26, which completely separates the collar 22 from the cylinder element 21. The membrane 26 may be constructed in one piece with the adapter 3 or fitted as a separate element into the adapter 3, the membrane 26 then preferably being fixed in bonded manner in the adapter 3.

Figure 7:
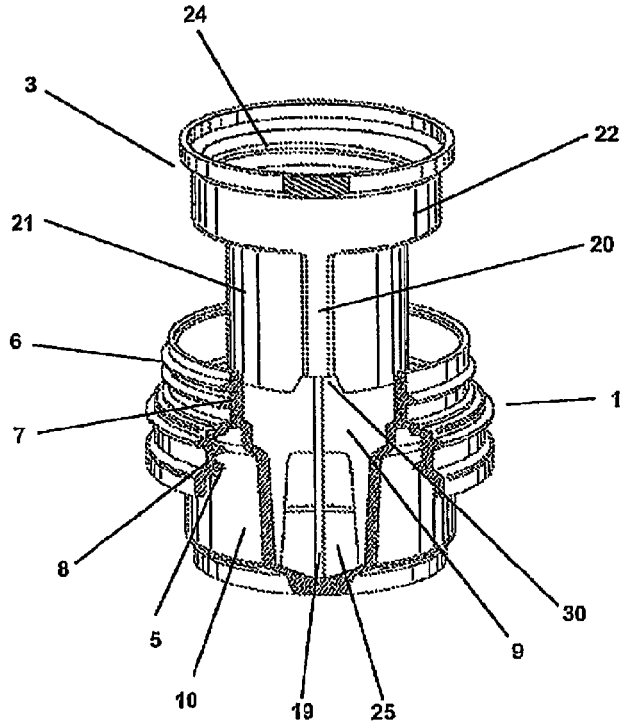
FIG. 7 shows the pourer and adapter element in the coupled state in a perspective view, with a partial section through the pourer.

The cylinder element 21 furthermore comprises a guide groove 20 configured such that the cylinder element 21, as is apparent for example from FIG. 7, may be pushed detachably over the funnel 9 and a web 19 of the pourer 1 protruding out of the funnel plane. In this way, the position of the adapter element 3 relative to the pourer 1 is fixed by a type of lock and key principle.

Figure 4:
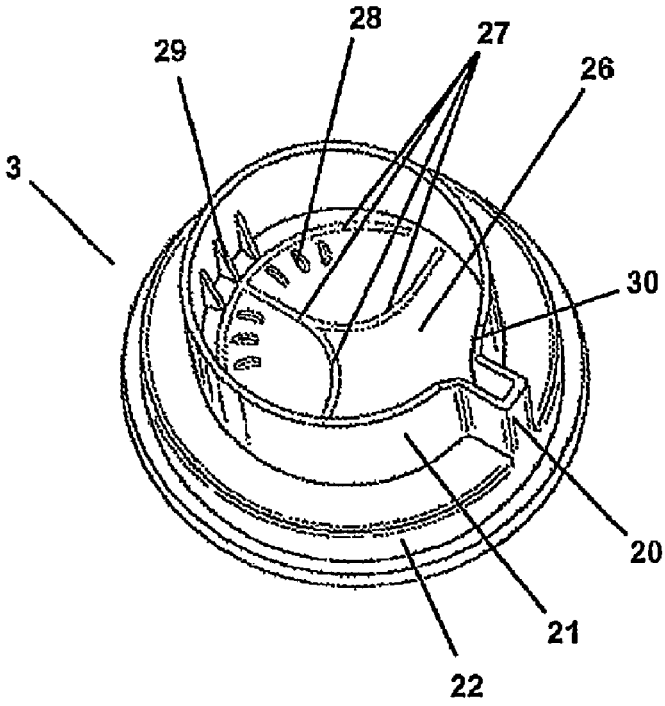
FIG. 4 is a perspective view of an adapter element illustrating the membrane surface on the pourer side.

FIG. 4 will be looked at next, which shows the adapter element 3 in a perspective view onto the membrane surface 26 on the pourer side.

The first thing that is apparent is the U-shaped configuration of the guide groove 20 on the cylinder element 21. The membrane 26 comprises linear thin areas 27 on the membrane surface on the pourer side, which thin areas at least in part correspond to the projection of the funnel shape 9 of the pourer 1, such that when the adapter element 3 is coupled with the pourer 1 the funnel 9 at least in part abuts against the thin area 27.

Figure 9:
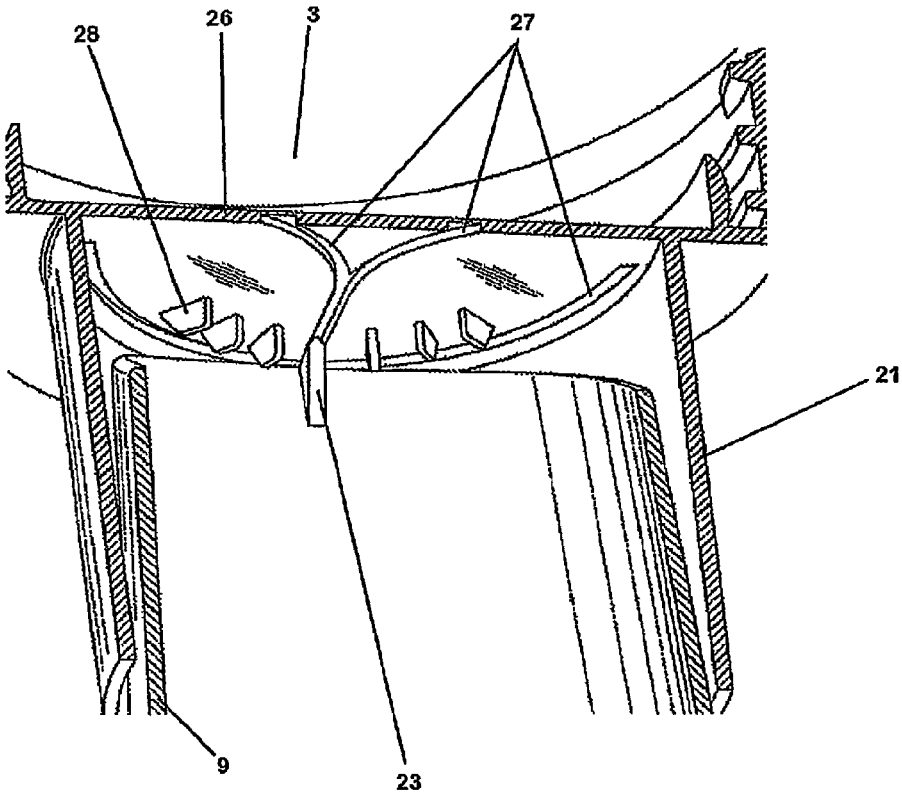
FIG. 9 is a cross-sectional perspective view of the funnel and membrane in the coupled state.
Figure 10:
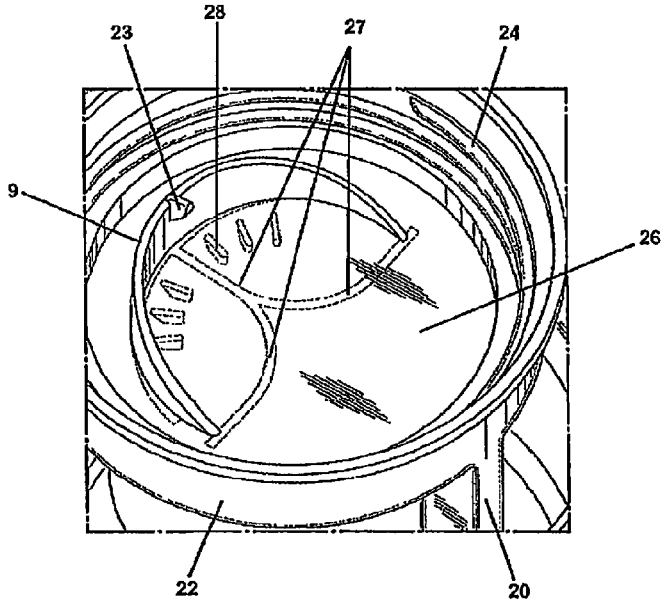
FIG. 10 is a perspective view of the funnel and membrane with the membrane in the pierced state.
Figure 11:
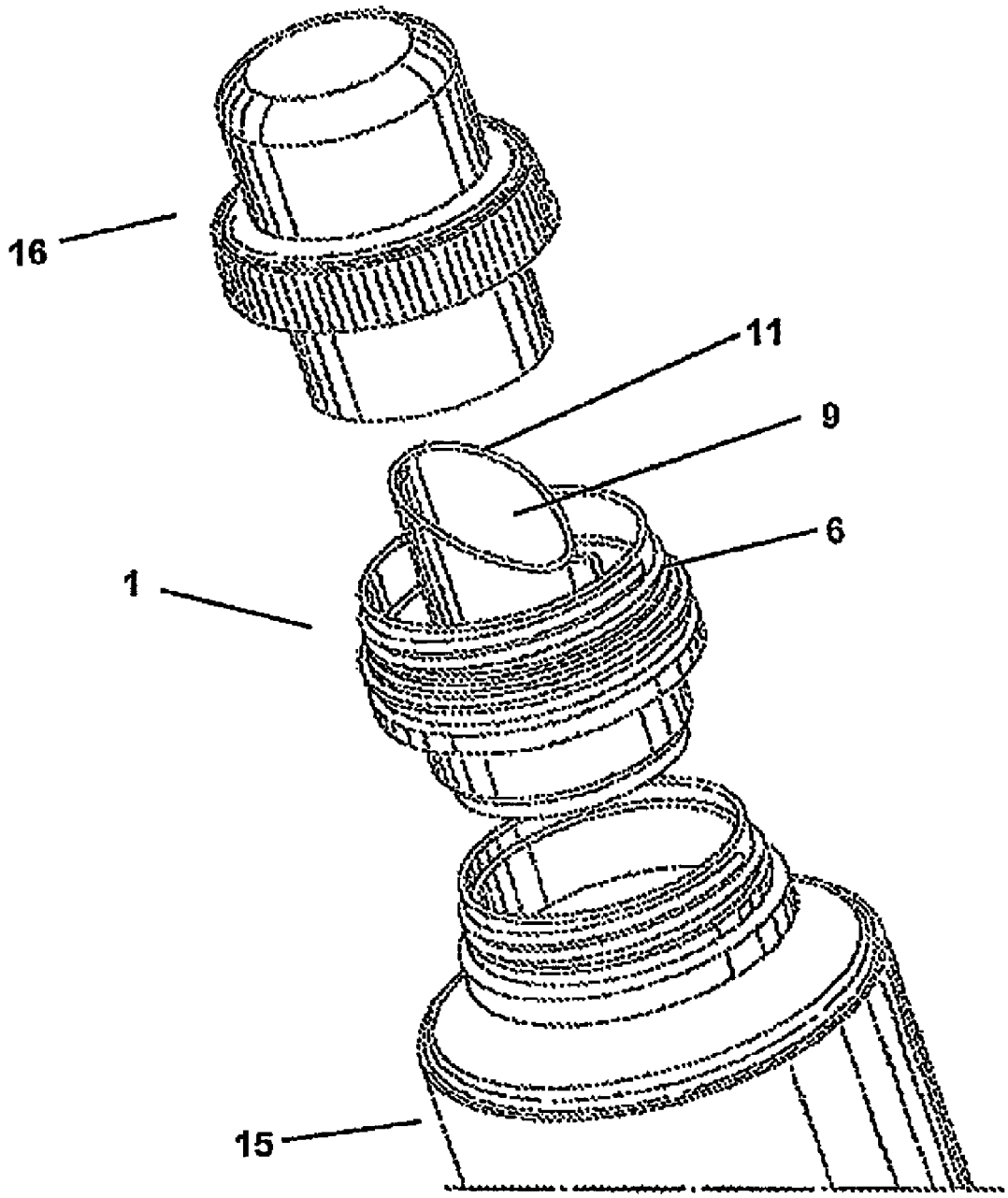
FIG. 11 is an exploded view of the bottle, pourer and closing cap.

The thin area 27 shown in FIG. 4 comprises a T-shaped portion directed towards the edge of the cylinder 21 and a Y-shaped portion, roughly in the middle of the membrane 26. The T-shaped portion is configured and positioned in such a way that it abuts against the tip 23 of the funnel 9 when the adapter element 3 is coupled with the pourer 1, as is apparent, for example, from FIG. 9.

This configuration of T- and Y-shaped portions leads, on piercing of the membrane 26 with the pourer 1, to the membrane 26 being divided into two wings along the T- and Y-shaped portions, thereby preventing unintentional blocking of the pouring orifice of the adapter orifice and ensuring defined tearing and opening of the pouring orifice.

Figure 8:
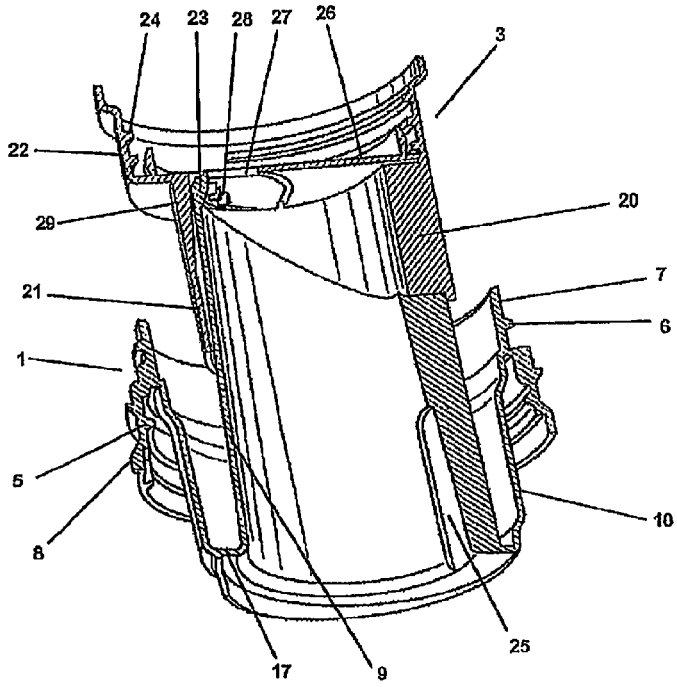
FIG. 8 is a cross-sectional perspective view of the pourer and adapter element in the coupled state.

Ramp-shaped guide ribs 29 are arranged on the inside of the cylinder element 21 in the region of the T-shaped thin area 27 and extend from the pouring orifice of the cylinder element 21 to the membrane 26. The guide ribs guide the tip 23 of the funnel 9 in a controlled manner during the coupling process against the area of the membrane 26 designed to be pierced, as is apparent from FIG. 8.

The guide groove 20 ends at a distance from the pouring edge of the cylinder element 21, a substantially V-shaped orifice 30 extending from the guide groove 20 to the pouring edge of the cylinder element 21. In this way pushing of the adapter element 3 over the funnel 9 is simplified, since the web 19 is guided automatically by the V-shaped orifice 30 into the guide groove 20 during the coupling process.

In addition, further ramp-like guide ribs 28 are arranged on the surface of the membrane 26 directed towards the pourer. These guide ribs 28 enable, on positioning of the pourer 1 onto the membrane 26, the pourer 1 to be guided accurately onto the thin area 27. To this end, the guide ribs 28 are of ramp-like construction, falling away towards the cylinder 21, such that the pourer is guided automatically into the correct position over the thin area 27 during positioning, even if the pourer 1 is not positioned accurately by the user during the coupling process or the funnel 9 of the pourer 1 is deformed on exposure to pressure during the coupling process.

Figure 5:
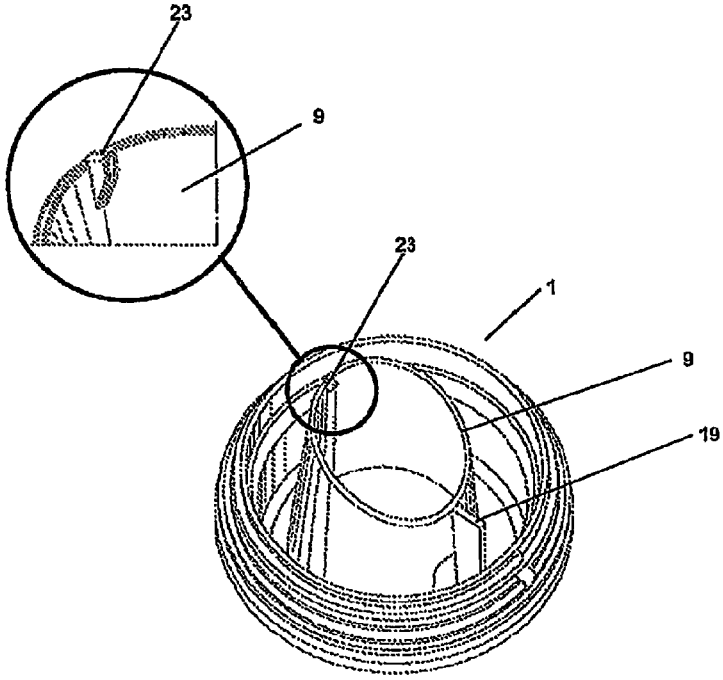
FIG. 5 shows the pourer in a top perspective view.
Figure 6:
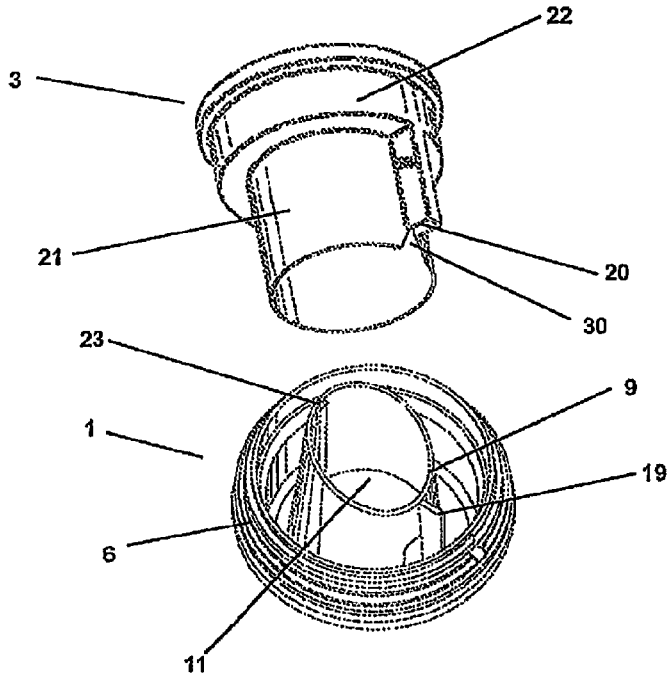
FIG. 6 is a perspective view of the pourer and adapter element in the uncoupled state.

FIG. 5 shows a detail, in perspective plan view, of the pourer, from which is illustrated a tip 23 arranged on the part of the funnel 9 furthest away from the interior of the bottle 15, which tip projects beyond the edge of the funnel 9. As is likewise apparent from the detail shown in FIG. 5, the tip 23 is shaped as a rib on the inner wall of the funnel. The tip 23 preferably lies directly opposite the web 19 in a line.

The invention is, of course, not limited to the described exemplary embodiment. Further developments are possible without extending beyond the scope defined in the claims.

We claim:

1. System for refilling flowable or pourable washing or cleaning agents comprising:

a pourer positionable on the orifice of a bottle, the pourer comprising a first collar with a fastener for liquid-tight fastening of the pourer on a bottle, a second collar with a fastener for liquid- and/or gas-tight fastening of a closure and/or dispensing cap on the pourer, a wall extending from the first collar or second collar towards the interior of the bottle, a funnel extending from the shoulder of the wall beyond the collar out of the side of the pourer turned away from the interior of the bottle, the funnel comprising a funnel orifice, and an adapter element couplable with the pouring orifice of a refill container, said adapter element comprising a cylinder element, wherein at least one ramp-shaped guide rib is arranged on the inside of the cylinder element, said guide rib extending from the pouring orifice of the cylinder element to the membrane, and a peripheral collar connected to the cylinder element on which peripheral collar is arranged a fastening element for liquid-tight fastening of the adapter element, a membrane which, in the mounted state of the adapter element on the refill container, closes the refill container and prevents leakage of flowable or pourable washing or cleaning agents out of the refill container, wherein the cylinder element of the adapter element comprises a guide groove configured such that the cylinder element may be detachably pushed over the funnel and a web of the pourer protruding from the funnel plane, so fixing the position of the adapter element relative to the pourer, and wherein the guide groove ends at a distance from the pouring edge of the cylinder element and a substantially V-shaped orifice extends from the guide groove to the pouring edge of the cylinder element.

2. System for refilling flowable or pourable washing or cleaning agents according to claim 1, wherein the membrane comprises one or more thin areas which at least in part correspond to the projection of the funnel shape.

3. System for refilling flowable or pourable washing or cleaning agents according to claim 2 wherein the projection of the funnel shape is a round or oval outline and wherein the one or more thin areas have at least one thin area of linear construction following said outline at least in portions such that, when the adapter element is coupled with the pourer, the funnel abuts against the thin area.

4. System for refilling flowable or pourable washing or cleaning agents according to claim 1, wherein a tip is arranged on the part of the funnel orifice furthest away from the interior of the bottle, which tip projects beyond the edge of the funnel orifice.

5. System for refilling flowable or pourable washing or cleaning agents according to claim 1, wherein the funnel orifice is constructed as an obliquely truncated tube.

6. System for refilling flowable or pourable washing or cleaning agents according to claim 1, wherein a thin area comprising a substantially T-shaped portion is configured such that, on coupling of the adapter element with the pourer, it abuts against the tip of the funnel.

* * * * *